US007564028B2

(12) United States Patent
Vestal

(10) Patent No.: US 7,564,028 B2
(45) Date of Patent: Jul. 21, 2009

(54) VACUUM HOUSING SYSTEM FOR MALDI-TOF MASS SPECTROMETRY

(75) Inventor: Marvin L. Vestal, Framinghan, MA (US)

(73) Assignee: Virgin Instruments Corporation, Sudbury, MA (US)

( * ) Notice: Subject to any disclaimer, the term of this patent is extended or adjusted under 35 U.S.C. 154(b) by 304 days.

(21) Appl. No.: 11/742,679

(22) Filed: May 1, 2007

(65) Prior Publication Data

US 2008/0272286 A1 Nov. 6, 2008

(51) Int. Cl.
*H01J 49/04* (2006.01)

(52) U.S. Cl. ..... 250/288; 250/281; 250/287; 250/289; 436/47; 436/173

(58) Field of Classification Search ..... 250/281, 250/282, 287, 288, 289; 436/47, 173
See application file for complete search history.

(56) References Cited

U.S. PATENT DOCUMENTS

| | | | |
|---|---|---|---|
| 4,730,111 | A | 3/1988 | Vestal et al. |
| 4,731,533 | A | 3/1988 | Vestal |
| 4,766,312 | A | 8/1988 | Fergusson et al. |
| 4,814,612 | A | 3/1989 | Vestal et al. |
| 4,861,989 | A | 8/1989 | Vestal et al. |
| 4,883,958 | A | 11/1989 | Vestal |
| 4,902,891 | A | 2/1990 | Vestal |
| 4,958,529 | A | 9/1990 | Vestal |
| 4,960,992 | A | 10/1990 | Vestal et al. |
| 5,015,845 | A | 5/1991 | Allen et al. |
| 5,160,840 | A | 11/1992 | Vestal |
| 5,498,545 | A | 3/1996 | Vestal |
| 5,625,184 | A | 4/1997 | Vestal et al. |
| 5,627,369 | A | 5/1997 | Vestal et al. |
| 5,760,393 | A | 6/1998 | Vestal et al. |

(Continued)

FOREIGN PATENT DOCUMENTS

| | | |
|---|---|---|
| GB | 2 370 114 | 6/2002 |

(Continued)

OTHER PUBLICATIONS

R. Kaufmann, et al., "Sequencing of Peptides in a Time-of-Flight Mass Spectrometer-Evaluation of Postsource Decay . . . ," Int. J. Mass Spectrom. Ion Process. 131: 355-385 (1994).

(Continued)

*Primary Examiner*—Jack I Berman
(74) *Attorney, Agent, or Firm*—Kurt Rauschenbach; Rauschenbach Patent Law Group, LLC

(57) ABSTRACT

The present invention is directed to ion source and vacuum housings for use in MALDI-TOF mass spectrometry which operates with any type of mass analyzer including linear, reflector, or tandem TOF-TOF instruments. By removing the requirement for the vacuum lock, the present invention allows operation of the ion source vacuum chamber at a pressure at least two orders of magnitude higher than conventional instruments. The present invention also requires only a single valve that isolates the ion source vacuum housing from the TOF analyzer vacuum housing. This is a significant improvement over vacuum locks in the art where the valve opening must be sufficiently large to allow the sample plate to pass through.

25 Claims, 8 Drawing Sheets

U.S. PATENT DOCUMENTS

| | | | | |
|---|---|---|---|---|
| 6,002,127 | A | 12/1999 | Vestal et al. | |
| 6,057,543 | A | 5/2000 | Vestal et al. | |
| 6,175,112 | B1 | 1/2001 | Karger et al. | |
| 6,281,493 | B1 | 8/2001 | Vestal et al. | |
| RE37,485 | E | 12/2001 | Vestal | |
| 6,348,688 | B1 | 2/2002 | Vestal | |
| 6,414,306 | B1 | 7/2002 | Mayer-Posner et al. | |
| 6,441,369 | B1 | 8/2002 | Vestal et al. | |
| 6,504,150 | B1 | 1/2003 | Verentchikov et al. | |
| 6,512,225 | B2 | 1/2003 | Vestal et al. | |
| 6,534,764 | B1 | 3/2003 | Verentchikov et al. | |
| 6,541,765 | B1 | 4/2003 | Vestal | |
| 6,621,074 | B1 | 9/2003 | Vestal | |
| 6,670,609 | B2 | 12/2003 | Franzen et al. | |
| 6,674,070 | B2 | 1/2004 | Karger et al. | |
| 6,770,870 | B2 | 8/2004 | Vestal | |
| 6,825,463 | B2 | 11/2004 | Karger et al. | |
| 6,825,466 | B2 * | 11/2004 | Mordekhay | 250/288 |
| 6,831,270 | B2 | 12/2004 | Furuta et al. | |
| 6,844,545 | B1 | 1/2005 | Hutchins et al. | |
| 6,900,061 | B2 | 5/2005 | Smirnov et al. | |
| 6,918,309 | B2 | 7/2005 | Brock et al. | |
| 6,933,497 | B2 | 8/2005 | Vestal | |
| 6,936,224 | B2 * | 8/2005 | Fichera et al. | 436/47 |
| 6,952,011 | B2 | 10/2005 | Brown et al. | |
| 6,953,928 | B2 | 10/2005 | Vestal et al. | |
| 6,995,363 | B2 | 2/2006 | Donegan et al. | |
| 7,030,373 | B2 | 4/2006 | Vestal et al. | |
| 7,064,319 | B2 | 6/2006 | Hashimoto et al. | |
| 7,109,480 | B2 | 9/2006 | Vestal et al. | |
| RE39,353 | E | 10/2006 | Vestal | |
| 7,176,454 | B2 | 2/2007 | Hayden et al. | |
| 7,405,396 | B2 * | 7/2008 | Cygan et al. | 250/288 |
| 2003/0057368 | A1 | 3/2003 | Franzen et al. | |
| 2003/0116707 | A1 | 6/2003 | Brown et al. | |
| 2005/0031496 | A1 | 2/2005 | Laurell et al. | |
| 2005/0087685 | A1 | 4/2005 | Bouvier et al. | |
| 2005/0130222 | A1 | 6/2005 | Lee et al. | |
| 2005/0178959 | A1 | 8/2005 | Lopez-Avila et al. | |
| 2006/0266941 | A1 | 11/2006 | Vestal | |
| 2006/0273252 | A1 | 12/2006 | Hayden et al. | |
| 2007/0038387 | A1 | 2/2007 | Chen et al. | |
| 2007/0054416 | A1 | 3/2007 | Regnier et al. | |

FOREIGN PATENT DOCUMENTS

| | | | |
|---|---|---|---|
| WO | WO 2004/018102 | A1 | 3/2004 |
| WO | WO 2005/061111 | A2 | 7/2005 |

OTHER PUBLICATIONS

J. Preisler, et al., "Capillary Array Electrophoresis-MALDI Mass Spectrometry using a Vacuum Deposition Interface," Anal. Chem. 74: 17-25 (2002).

R. L. Caldwell and R. M. Caprioli, "Tissue Profiling by Mass Spectrometry," MCP 4: 394-401 (2005).

M. L. Vestal, et al., "Delayed Extraction Matrix-Assisted Laser Desorption Time-of-Flight Mass Spectrometry," Rapid Comm. Mass Spectrom. 9: 1044-1050 (1995).

M. L. Vestal and P. Juhasz, "Resolution and Mass Accuracy in Matrix-Assisted Laser Desorption Time-of-Flight Mass Spectrometry," J. Am. Soc. Mass Spectrom. 9: 892-911 (1998).

E. J. Takach, et al., "Accurate Mass Measurement using MALDI-TOF with Delayed Extraction," J. Prot. Chem. 16: 363-369 (1997).

D. J. Beussman, et al., "Tandem Reflectron Time-of-Flight Mass Spectrometer Utilizing Photodissociation," Anal. Chem. 67: 3952-3957 (1995).

M. L. Vestal, "High-Performance Liquid Chromatography-Mass Spectrometry," Science 226: 275-281 (1984).

* cited by examiner

VACUUM HOUSING SYSTEM FOR MALDI-TOF MASS SPECTROMETRY

BACKGROUND OF THE INVENTION

Matrix assisted laser desorption/ionization time-of-fight mass (MALDI-TOF) spectrometry is an established technique for analyzing a variety of nonvolatile molecules including proteins, peptides, oligonucleotides, lipids, glycans, and other molecules of biological importance. While this technology has been applied to many applications, widespread acceptance has been limited by many factors including cost and complexity of the instruments, relatively poor reliability, and insufficient performance in terms of speed, sensitivity, resolution, and mass accuracy.

In the art, different types of TOF analyzers are required depending on the properties of the molecules to be analyzed. For example, a simple linear analyzer is preferred for analyzing high mass ions such as intact proteins, oligonucleotides, and large glycans, while a reflecting analyzer is required to achieve sufficient resolving power and mass accuracy for analyzing peptides and small molecules. Determination of molecular structure by MS-MS techniques requires yet another analyzer. In some commercial instruments all of these types of analyzers are combined in a single instrument. This has the benefit of reducing the cost somewhat relative to three separate instruments, but the downside is a substantial increase in complexity, reduction in reliability, and compromises are required that make the performance of all of the analyzers less than optimal.

The prior art instruments also require large and expensive computer-controlled valves at the entrance to the vacuum lock and between the vacuum lock and the ion source vacuum housing to allow loading of MALDI sample plates.

SUMMARY OF THE INVENTION

The present invention is directed to a vacuum housing system for MALDI-TOF mass spectrometry that overcomes the limitations of the prior art and provides optimal performance with any type of mass analyzer including linear, reflector, or tandem TOF-TOF instruments.

With an appreciation of the importance of simplicity, reliability, at minimum cost, the present invention provides improved performance through optimization of speed, sensitivity, resolution, and mass accuracy of the analytical system.

Furthermore, while instruments of the prior art require large, complex vacuum systems with a vacuum lock chamber for loading sample plates which achieve and maintain high vacuum pressures (less than $10^{-6}$ torr) in the ion source vacuum chamber, the present invention removes the requirement for the vacuum lock allowing operation of the ion source vacuum chamber at a pressure at least two orders of magnitude higher (ca. less than $10^{-4}$ torr).

The present invention also solves the problem in the art relating to valves by requiring only a single valve that isolates the ion source vacuum housing from the TOF analyzer vacuum housing instead of large and expensive computer-controlled valves. As such, the aperture between the two housing in the present invention can be quite small (approximately 3 mm in diameter or smaller) since only the ion beam must pass through. This is a significant improvement, considering that the valve opening of vacuum locks in the art must be sufficiently large to allow the sample plate to pass through, often being at least 10×125 mm.

Specifically, in one embodiment of the present invention, is provided a system for use in MALDI-TOF mass spectrometry comprising: (a) an ion source housing comprising: (i) an x-y table for receiving and moving a sample plate in two dimensions transverse to the axis of a laser beam, (ii) a sample plate holder for receiving said sample plate, and (iii) a spring-loaded flap valve driven open by motion of the x-y table; (b) a TOF analyzer housing; (c) a housing aperture located between the ion source housing and the TOF analyzer housing (d) a vacuum generator system operably connected to the ion source housing, for evacuating the vacuum housing when the spring-loaded flap valve is closed capable of reducing the pressure in the source housing from atmospheric pressure to a predetermined operating pressure (ca. $10^{-4}$ torr) within a predetermined time; (e) a gate valve having an aperture, for isolating the vacuum housing from the analyzer vacuum wherein in the open position an aperture in the gate valve is aligned with the aperture in the extraction electrode allowing the laser beam to enter and the ion beam to exit and closes the aperture between the ion source housing and the analyzer housing so that the pressure in the analyzer is unaffected even if the ion source housing is vented to atmospheric pressure; (f) an extraction electrode having an aperture aligned with the laser beam in close proximity to the gate valve and (g) a high-voltage pulse generator which can be operably connected to the sample plate causing the potential on the plate to be switched from the potential applied to the extraction electrode to a predetermined voltage at a predetermined time after the laser pulse strikes the sample plate.

According to the present invention the portion of the x-y table for receiving a sample plate may be electrically insulated from the ion source housing and is electrically connected through a vacuum feed-through in the ion source housing to an external high-voltage pulse generator.

Further, the electrical capacitance between the sample plate and the ion source housing may be independent of the x-y position of the sample plate.

The present invention embraces a system wherein the high-voltage pulse generator produces a pulse up to 10 kilovolts in amplitude at frequencies up to 5 kilohertz.

In one embodiment, the distance between the sample plate and the extraction electrode is as small as practical without causing an electrical discharge.

In one embodiment, the space between the extraction electrode and the gate valve is in vacuum communication with the ion source housing via the extraction electrode aperture and is in vacuum communication with the analyzer housing when the gate valve is open.

In one embodiment, the diameter of the aperture in the extraction electrode is less than the diameter of the aperture in the gate valve.

The present invention may also include a baffle plate located to intercept matrix molecules desorbed from the sample plate and passing through the open gate valve. It may further comprise a heater for heating said baffle plate.

In one embodiment, the x-y table has the capacity to receive sample plates up to 127×124×3 mm in dimension.

In one embodiment, the system further comprises a laser detector which is located behind a window in the ion source housing opposite the extraction electrode aperture. The laser detector may alternatively be located behind one or more apertures of predetermined size and position in the sample plate and sample plate holder.

In one embodiment the system comprises a surrogate sample plate compatible with the sample plate holder and which is used to clean matrix or other contaminants from the surface of the extraction electrode by programmed action of the x-y table. The surrogate plate may also acts as a sample plate.

In one embodiment, the system comprises ion focusing lenses and deflection electrodes which may be located between the extraction electrode and the gate valve.

In one embodiment is disclosed a method for performing MALDI-TOF mass spectrometry comprising (a) turning the high-voltage pulse and vacuum generators off and closing the gate valve, (b) opening a vent valve in the ion source vacuum housing to bring the housing to atmospheric pressure, (c) activating the x-y table to drive open the spring-loaded flap valve to expose the sample plate holder, (d) inserting a sample plate containing samples into the sample plate holder, (e) activating the x-y table to draw the sample plate holder into the ion source housing and the spring-loaded flap valve is allowed to close, (f) evacuating the ion source housing to operating pressure by activating the vacuum generator, (g) opening the gate valve and turning on the high-voltage pulse generator, (h) positioning the sample plate to predetermined locations via movement of the x-y table, and (i) performing MALDI-MS at selected sample spots.

In one embodiment is provided a method for aligning a predetermined position on a MALDI sample plate with coordinates of the x-y table comprising (a) providing a MALDI sample plate and sample plate holder each having one or more holes in a predetermined positions relative to the position of samples of interest on the plate, (b) moving the x-y table containing the sample plate and holder in small increments about the position of a hole relative to the laser beam and (c) determining the x-y coordinates of the hole as midway between the points in both dimension at which the laser intensity as determined by the laser detector is reduced by one-half of its maximum intensity.

In one embodiment is provided a method for cleaning the extraction electrode of the system of the invention comprising (a) turning the high-voltage pulse and vacuum generators off and closing the gate valve, (b) opening a vent valve in the ion source vacuum housing to bring the housing to atmospheric pressure, (c) activating the x-y table to drive open the spring-loaded flap valve to expose the sample plate holder, (d) removing the sample plate if present in the holder and replacing it with a surrogate sample plate having a cleaning device for cleaning matrix deposits or other contaminants from the extraction electrode, and (e) activating the x-y table to move the surrogate sample plate in a predetermined pattern such that the cleaning device of the surrogate sample plate operates to remove matrix deposits or other contaminants from the surface of the extraction electrode. The system may be returned to operation mode by activating the x-y table to drive open the spring-loaded flap valve exposing the sample plate holder containing the surrogate sample plate, followed by removing the surrogate sample plate in the holder and placing a sample plate in the sample plate holder.

In one embodiment the cleaning device comprises an abrasive pad or involves the formation of a liquid jet or spray directed to the surface of the extraction electrode wherein the composition of the liquid is a solvent for the matrix compounds. The cleaning device may also comprise a lint-free cloth pad.

In one embodiment is provided a method for cleaning a baffle plate of the system of the invention comprising (a) closing the gate valve, and (b) activating the heater for a predetermined time at a predetermined power input. The system may then be returned to operational mode by opening the gate valve and turning off the heater.

In one embodiment, the steps of cleaning may be automated or configured to operate under computer control.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
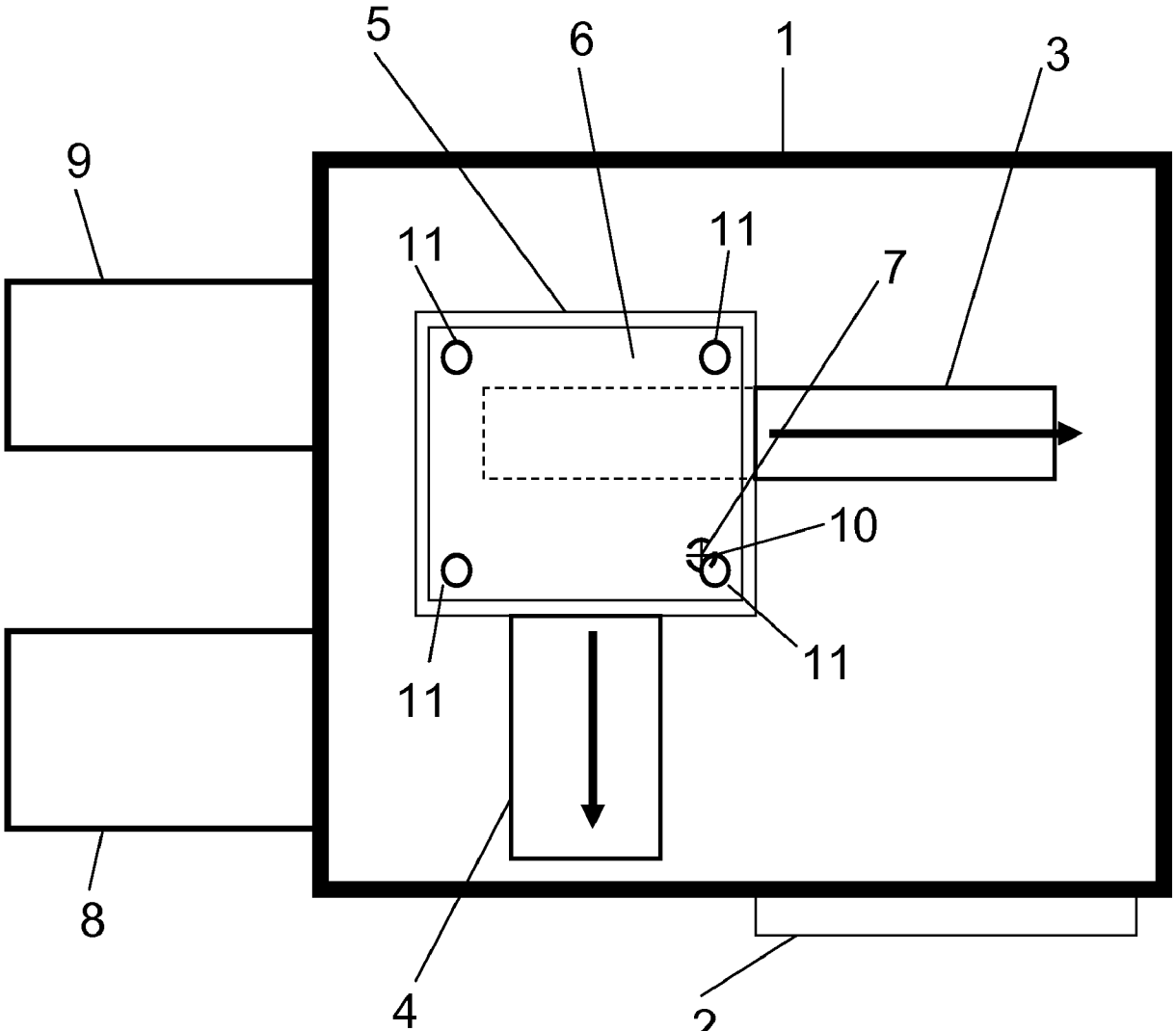
FIG. 1 is top view of one embodiment of the ion source and vacuum housing according to the invention.

A description of preferred embodiments of the invention follows.

The present invention, while comprising some or all of the major components common to TOF systems in the art, is superior to these systems in functionality and operation as it does not require a vacuum lock and employs a tiny aperture between the housings. These common components may include, but are not limited to, the ion source vacuum housing, the vacuum generator for evacuating the ion source housing, an x-y table within the ion source vacuum housing, a sample plate holder mounted on the x-y table for receiving a sample plate, a flap valve providing access for loading plates into the vacuum housing, a gate valve for isolating the ion source housing from the analyzer housing, an extraction electrode and associated ion optics for accelerating ions and directing them into the analyzer, motion control electronics for the x-y table, high-voltage pulser, laser and laser optics and controls, and digitizer and computer.

To this end, in the present invention, the gate valve includes an aperture that is aligned with an aperture in the extraction electrode when the valve is open allowing the laser beam to pass through both apertures and strike the ion source producing ions by the MALDI process. Ions are accelerated through the apertures into the analyzer along a trajectory at a small angle relative to the laser beam direction.

The ion source vacuum housing (or ion source housing) includes a sample plate loading port for loading sample plates from a location external to the housing onto the sample plate holder mounted on the x-y table within the ion source vacuum housing, and also a port coupling the ion source vacuum housing to the vacuum generator. The sample plate loading port is equipped with a flap valve that is normally held closed by means including a spring that supplies sufficient force to close the flap valve. In normal operation the flap valve is closed, the vacuum generator is activated to produce a vacuum in the ion source vacuum housing, and the gate valve is opened to allow the laser beam to strike a predetermined location on the sample plate containing matrix crystals with samples of interest and produce ions by MALDI. Ions are accelerated by the electrical field between the sample plate and the extraction electrode by applying a high-voltage pulse to the sample plate from the high-voltage pulse generator. Ions exit the ion source housing through the apertures in the extraction electrode and the gate valve and are analyzed by the TOF analyzer in the TOF analyzer housing (or TOF analyzer vacuum housing).

After all of the samples on a sample plate have been analyzed the sample plate may be removed and replaced by another sample plate containing a new set of samples by the following procedure.

First, the high voltage pulse generator is turned off and the gate valve between the ion source vacuum housing and the analyzer vacuum housing is closed to isolate the analyzer vacuum housing from the ion source vacuum housing. The vacuum generator coupled to the analyzer housing is maintained in operation; the vacuum generator coupled to the ion source housing is turned off and a vent valve is opened bringing the ion source housing to ambient pressure. The x-y table is then activated to bring the sample plate holder in alignment with the sample plate loading port and to press the sample plate holder against the surface of the flap valve, forcing the valve open and positioning the sample plate holder so that a sample plate in the sample plate holder may be removed by external means and a new sample plate loaded. The x-y table is then activated to withdraw the sample plate holder and loaded sample plate into the ion source vacuum housing and the spring-loaded flap valve is allowed to close. The vacuum generator connected to the ion source housing is activated, and after the vacuum in the ion source housing reaches a predetermined maximum operating pressure the high-voltage pulse generator is turned on. The sample plate is moved by the x-y table to predetermined positions corresponding to the locations of sample of interest, and ions are produced by MALDI and directed to the analyzer.

A sample plate holder is provided for holding the loaded sample plate in a known position relative to the x-y table. The holder is electrically insulated from the x-y table and is electrically connected to an external high-voltage pulse generator through a vacuum feedthrough. It will be understood, that any or all of the steps of the procedure may be automated using a computer or computer system.

In the prior art this connection is made by a flexible high-voltage cable of sufficient length that the x-y table can moved freely to allow any position on the plate to be addressed by the laser beam. At least two problems have been identified with this approach.

First, repeated flexing of the cable may cause failure of either the electrical conductor or the electrical insulator surrounding the conductor causing either the electrical connection to be broken or the electrical insulation on the high-voltage cable to be damaged. This may introduce electrical breakdown causing instability, or in extreme cases, damage to the high-voltage pulse generator.

Second, the electrical capacitance between the sample plate and ground varies with location of the sample plate since a major portion is due to capacitance between the cable and ground, and this varies in an unpredictable manner as the cable flexes and changes its position. The present invention overcomes these problems by providing a pair of rigid electrical conductors with sliding contacts to allow continuous connection between the high-voltage pulse generator and the sample plate at any x-y position. Thus the electrical capacitance to ground is small and constant, and there is no motion of the electrical conductors accompanying the motion of the x-y table.

In one embodiment of the present invention, the amplitude of the high-voltage pulse is 10 kilovolts and the frequency of the laser and the high-voltage pulse is 5 kilohertz. In order to operate successfully at these high amplitudes and high frequencies is it important to keep the total capacitance between the sample plate and ground as small as practical, and also to keep this capacitance constant. The high-voltage pulse generator operates by periodically connecting a charged capacitor within the generator to the capacitance of the ion source to ground. Thus the voltage applied to the sample plate, $V_s$, relative to the voltage, $V_i$ on the internal charged capacitor is given by $$V_s = V_i C_i / (C_i + C_s) \quad (1)$$

Where $C_i$ is the internal capacitance of the high-voltage pulse generator, and $C_s$ is the capacitance to ground of the sample plate. Any variation in $C_s$ produces a variation in the voltage applied to the sample plate, thus changing the magnitude of the acceleration applied to the ions. This causes an uncontrolled variation in the performance of the TOF mass spectrometer with position of the sample plate affecting in particular the resolving power and accuracy of the mass measurement.

In some TOF analyzer designs it is important to keep the distance between the sample plate and the extraction electrode as small as possible without initiating an electrical discharge. The capacitance between the sample plate and the extraction electrode is inversely proportional to the distance between them and directly proportional to the area of the overlap between the electrodes. Thus, if the area is reduced in the same proportion as the distance, then the capacitance is independent of the distance between the sample plate and the extraction electrode.

In one embodiment of the present invention, the distance between the sample plate and the extraction electrode is 3 mm, and the outer diameter of the electrode is 25 mm with a 1.5 mm aperture in the center of the plate. The overall dimension of the sample plate holder with sample plate installed is 133×127 mm, and the active area where samples may be deposited is 108×102 mm with a flat portion 12.5 mm wide around the outside. Thus the area of overlap between the sample plate and the extraction electrode is independent of position within the active area of the sample plate including spots at the outer edges of the plate. The x-y table moves the sample plate in a plane accurately aligned with the extraction electrode, and the sample plate is substantially flat so that neither the distance between the sample plate and the extraction plate nor the area of overlap varies with x-y position.

In one embodiment the extraction electrode is enclosed so that the space between the extraction electrode and the gate valve is only in vacuum communication with the ion source housing through the aperture in the extraction electrode and is in vacuum communication with the analyzer vacuum when the gate valve is open.

In one embodiment the diameter of the aperture in the extraction electrode is small compared to the diameter of the aperture in the gate valve. In one embodiment the diameter of the aperture in the extraction electrode is 1 mm and the diameter of the aperture in the gate valve is 10 mm. Thus, the conductance of the aperture in the gate valve is approximately 100 times larger than that of the aperture in the extraction electrode. In this embodiment the volume of the enclosed volume is very small compared to the volume of either the ion source vacuum housing or the analyzer housing.

In one embodiment the volume of the enclosed space between the extraction electrode and gate valve is less than 1 part in 5000 of the volume of the analyzer. In some embodiments this enclosed space may include ion optical elements such as focusing lenses and deflectors; in these cases the electrical leads necessary to activate the ion optical elements are brought into the enclosed space through vacuum feedthroughs so that the substantially all of the vacuum communication between the ion source vacuum housing and the enclosed space is through the aperture in the extraction electrode.

Limiting the distance that the ions travel within the vacuum of the ion source vacuum housing substantially reduces the vacuum requirements for the housing. Generally, it has been observed that a vacuum in the low $10^{-7}$ torr range is sufficient with total ion paths on the order of 3 m. Under these conditions the probability that collisions with neutral gas molecules significantly affect performance is small enough to be neglected. This is equivalent to a flight path of 3 mm in a vacuum in the low $10^{-4}$ torr range. In the prior art the conductance between ion source vacuum housing and the analyzer vacuum housing is relatively high so that it is necessary to attain a vacuum in the low $10^{-7}$ torr range in both housings to achieve satisfactory performance. This requires relatively large and expensive vacuum generators on both the ion source housing and the analyzer housing. Furthermore, a complex and expensive vacuum lock assembly is required for loading sample plates into the prior art systems since the time required to restore the vacuum to the operating range following venting to ambient atmosphere requires several hours even when large and expensive vacuum generators are employed. In contrast in an embodiment of the present invention the analyzer vacuum housing is always maintained at operating vacuum even when the ion source vacuum housing is vented to atmosphere to load and unload sample plates, and the time required to restore the ion source vacuum housing to an operating pressure less than $10^{-4}$ torr is less than 3 minutes after loading a sample plate.

An additional advantage of the invention is that materials used in the components within the ion source housing are less critical in terms of their vacuum properties since high ultimate vacuum is not required. This allows the use of motors to drive the x-y stage and other components that are less expensive than those that are suitable for use under high vacuum conditions.

In one embodiment the sample plate holder includes a pocket that is a close fit on the outside dimensions of the sample plate. The depth of the pocket is substantially equal to the thickness of the sample plate and the outer dimension sufficiently larger than the outer dimensions of the sample plate that a sample plate of specified dimensions within specified tolerances fits into the pocket with minimal clearance. In one embodiment the sample plate is held in the pocket magnetically. In one embodiment the outer portion of the sample plate is formed from magnetic stainless steel, and a plurality of permanent magnets are pressed into the sample holder in positions to hold the plate within the pocket. In another embodiment the sample plate holder is formed from magnetic material such as 400 series stainless steel, and permanent magnets are pressed into the sample plate in positions to hold the plate within the pocket. In yet another embodiment both the sample plate and the sample plate holder are formed from nonmagnetic materials and permanent magnets are pressed into the sample plate holder in selected positions, and additional permanent magnets are pressed into mating position in the sample plate with the magnets oriented similarly in both plate and plate holder, e.g. with the north pole up.

In one embodiment both the sample plate and the sample plate holder include one or more holes that are substantially in alignment when the sample plate is installed in the sample plate holder, and the holes in the sample plate holder are significantly larger than the holes in the sample plate. The locations of the hole or holes in the sample plate are accurately located relative to the predetermined locations of samples of interest. The ion source housing is provided with a window transparent to laser light and a laser light detector located opposite the extraction electrode. The laser beam is accurately aligned with the center of the aperture in the extraction electrode. To determine the location of a hole in the sample plate relative to the laser beam the x-y table is activated to move first in one direction and then the other and determine the x-y coordinates where the measured laser intensity is reduced by some predetermined amount. The laser beam is aligned to the center of the hole at the midpoint in both x and y of these points. The use of multiple alignment holes provides redundancy and also allows any imperfections in the x-y table to be determined and corrected. This plate alignment procedure allows the laser to be precisely directed to any predetermined location on the sample plate containing samples of interest. In the prior art, a video camera is employed to view the sample plate and to align the sample with the laser, but this is unnecessary with the present invention.

A major problem with long-term stability and reliability of MALDI mass spectrometers is contamination of electrode surfaces by matrix desorbed from the sample and deposited on the surface of the electrodes. This can cause build-up of insulating layers, and on surfaces exposed to the ion beam charging can occur that disrupts the performance of the ion optical system. In the earlier prior art systems, operating at laser rates of approximately 5 hz, this was not a serious problem since it might take a year or so of operation before the problem became apparent. In later prior art systems operating at 200 hz this problem became apparent and often required dismantling and cleaning the ion optical systems every few weeks. A MALDI system operating at 5 khz desorbs as much matrix in 24 hours as does a 200 hz system in 25 days and a 5 hz system in about 3 years. Most of the desorbed matrix (ca. 95%) is deposited on the surface of the extraction electrode. The remainder passes through the aperture in the extraction electrode and may be deposited on any surface in line of sight with the surface of the sample plate irradiated by the laser. Any surfaces downstream of the extraction electrode that are critical to the performance of the ion optics can be kept clean of significant deposition of matrix merely by the heating the surface by a moderate amount. On the other hand the extraction electrode is in close proximity to the sample plate making it difficult to heat the extraction electrode without also heating the sample plate and causing uncontrolled loss of sample from the sample plate.

The present invention provides a solution to this problem. In one embodiment a surrogate sample plate is provided that is compatible with the sample plate holder. This surrogate plate may contain means for cleaning matrix and other contaminants from the extraction electrode by programmed action of the x-y table. The cleaning procedure can be carried out in a few minutes and requires no disassembly of the instrument. To clean the extraction electrode the normal plate loading procedure is followed except that the sample plate is replaced with the surrogate sample plate. After the surrogate plate is loaded, the x-y table is moved in a predetermined manner to remove matrix and other contaminants from the surface of the extraction electrode. Cleaning means installed on the surrogate sample plate may include an abrasive pad in contact with the extraction electrode, a means for forming a liquid jet or spray directed toward the extraction electrode wherein the liquid is a solvent for the matrix compounds, and a lint-free cloth pad in contact with the extraction electrode. After the cleaning procedure is completed, the surrogate plate is removed from the holder and a new sample plate is installed, and sample analysis may proceed. If the system includes an automated sample plate handler, then this surrogate plate can be placed in the queue of sample plates and the entire cleaning process can be carried out automatically under computer control. In one embodiment, a sample plate may also contain a portion, grid or region dedicated to cleaning the electrode thereby serving as both a sample plate and a cleaning plate.

Referring now to FIG. 1, is a view of an ion source and vacuum housing according to the invention viewed from the top with the TOF analyzer housing and top plate of the vacuum housing removed. The vacuum housing 1 includes a flap valve 2 for loading and unloading sample plate 6 into the vacuum housing. A motor driven table supports a sample plate holder 5 and has components which direct the motion of the sample plate holder in two dimensions along x-axis 4 and y-axis 3. A laser beam 7 enters the vacuum chamber orthogonal to the plane of FIG. 1 in a predetermined location relative to a window 10 in the bottom of the chamber. The motor driven table is controlled by an external computer (not shown) that is capable of moving the sample plate holder 5 and sample plate 6 to bring any point on the sample plate into coincidence with the axis of the laser beam 7.

The sample plate 6 includes one or more holes 11 in predetermined positions on the sample plate relative to the positions of samples deposited on the plate. The sample plate holder 5 also includes holes nominally in line with the holes in the sample plate 6, but of larger diameter. When the sample plate 6 is moved so that one of the holes 11 is aligned with the laser beam 7, the laser beam passes through to the window 10 and is detected by a laser detector (12 shown in FIG. 2) outside the window. A vacuum generator 8 is attached to the vacuum housing 1 to evacuate the housing. The sample plate holder 5 is rigidly mounted to the table providing motion according to x-and y-axis components 4 and 3, but electrically insulated from the table and the housing. The sample plate 6 is rigidly mounted in the sample plate holder and is in good electrical contact with the holder. A high-voltage pulse generator 9 outside the vacuum chamber provides a voltage pulse to the sample plate holder and sample plate through a high-voltage vacuum feedthrough (See FIG. 4) and a novel rigid electrical connection system to the moveable sample plate holder.

Figure 2:
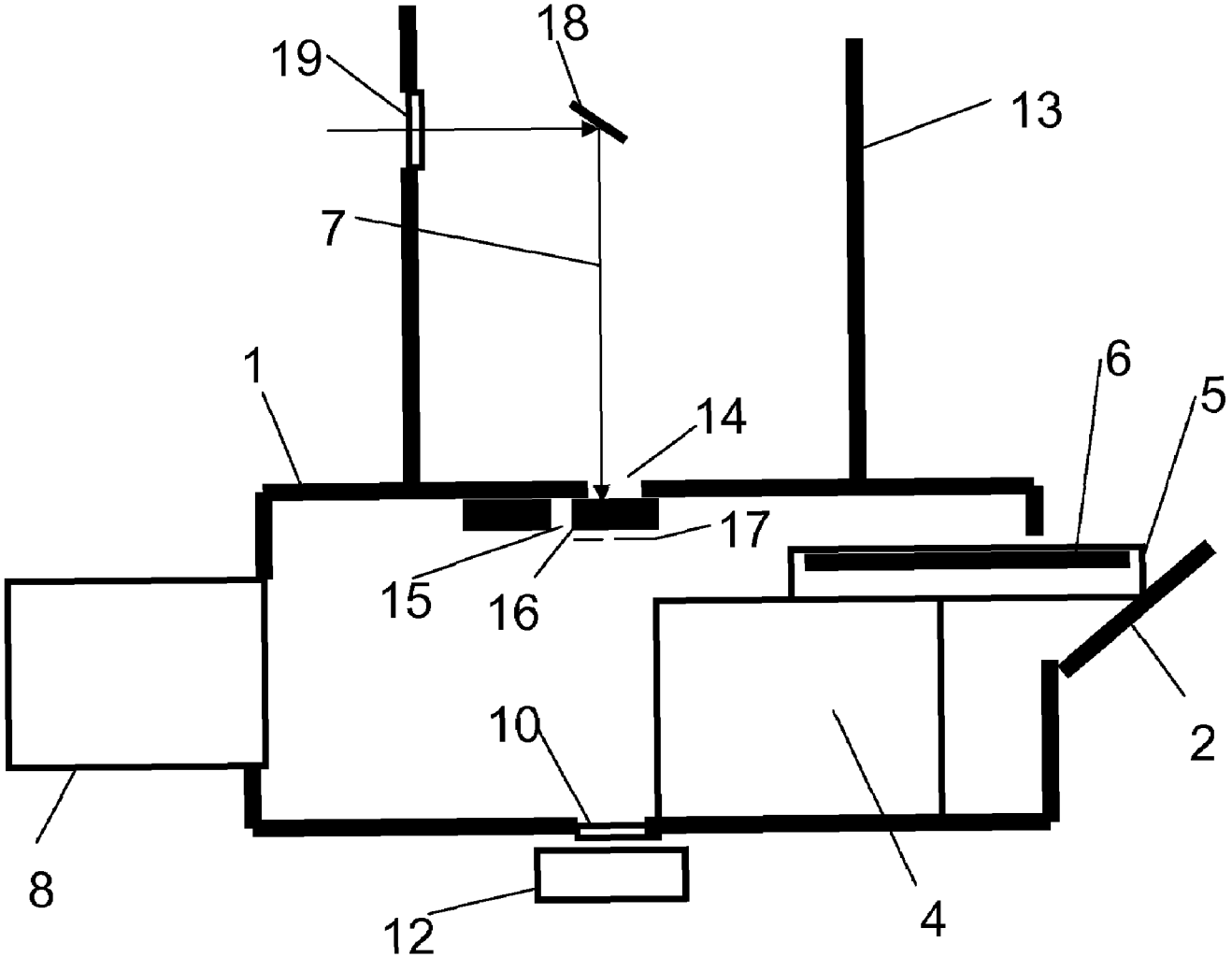
FIG. 2 is a partial cross-sectional side view with the sample plate and sample plate holder in the load position.

FIG. 2 represents a side view in which the sample plate holder 5 has been moved along the y-axis to align the sample plate holder with the flap valve 2, and then moved along x-axis by motor driven table component 4 to press the sample holder 5 against the flap valve, thus opening the valve and exposing the sample plate 6 to the outside for removal and replacement with a sample plate containing a new set of samples.

Before pressing open the flap valve the vacuum generator 8 and the high-voltage pulse generator 9 are turned off, the gate valve 16 is moved to the closed position, and a vent valve (not shown) is opened to bring the interior of the vacuum housing to ambient pressure. In the closed position an aperture in the gate valve slide 15 is displaced from the housing aperture 14 closing off the housing aperture 14 via a sealing apparatus such as an o-ring surrounding the aperture and pressing against the slide in the gate valve 16. A second vacuum generator (not shown) connected to the analyzer housing 13 remains in operation and maintains high vacuum in the analyzer housing.

After a sample plate 6 containing a new set of samples is loaded into the sample plate holder 5, the sample plate holder is retracted by activating motion in the x-axis of the x-axis component 4 allowing the spring-loaded flap valve 2 to close. The vent valve is then closed and the vacuum generator 8 is activation to evacuate the chamber.

Figure 3:
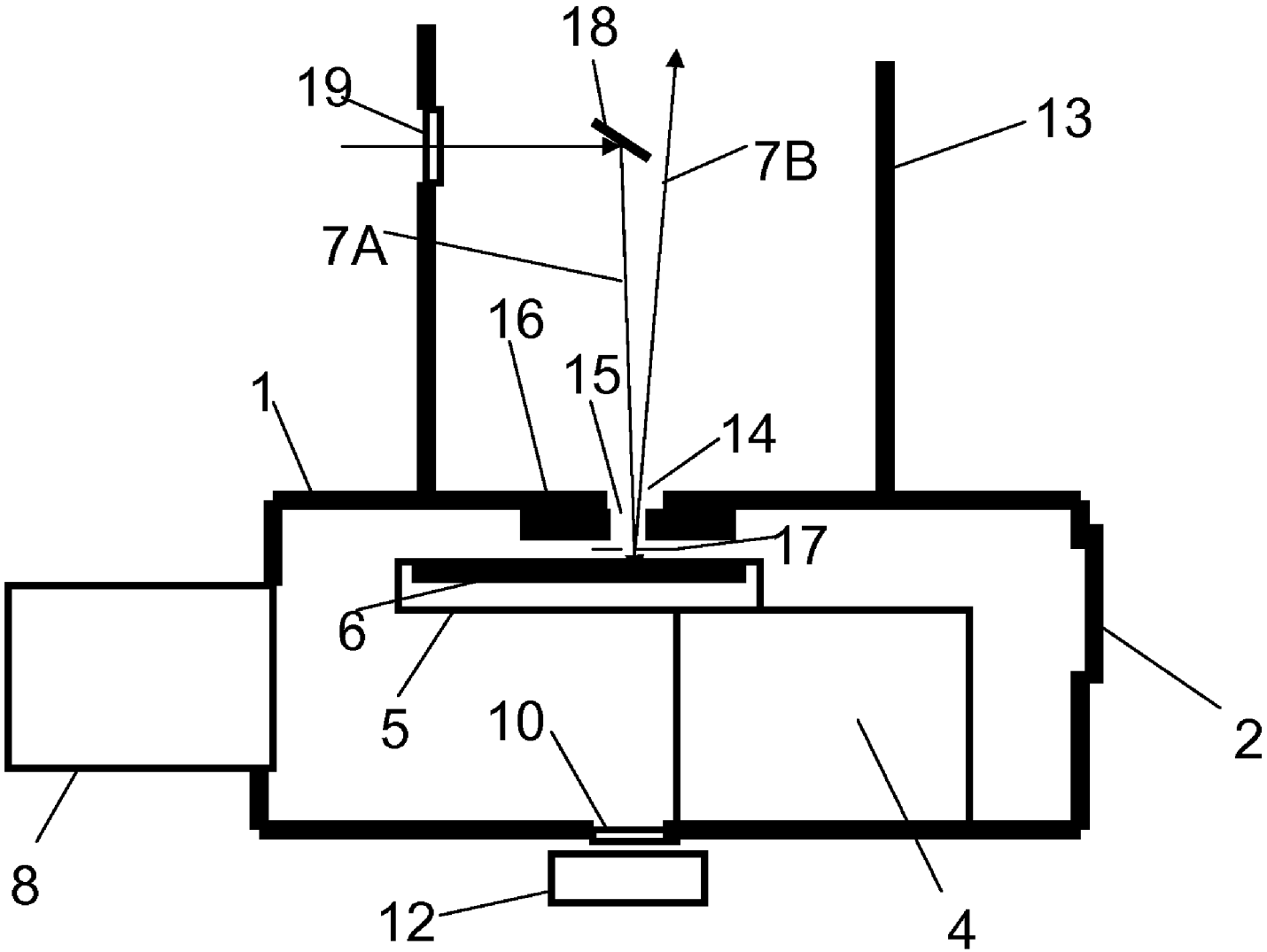
FIG. 3 is a partial cross-sectional side view with the sample plate and sample plate holder in the operate position.

When the pressure in the housing reaches a predetermined value as indicated by a vacuum gauge (not shown) the gate valve 16 is opened and the high-voltage pulse generator is turned on to return the ion source and vacuum housing to the operating condition illustrated in FIG. 3.

Referring now to FIG. 3, when the gate valve 16 is open the aperture in the valve slide 15 is aligned with an aperture in the extraction electrode 17 and the housing aperture 14. The laser beam generated by an external laser (not shown) enters the analyzer housing 13 through window 19 and is directed toward the sample plate 6 by a mirror 18. The mirror 18 is adjusted to direct the laser beam through aperture in the extraction electrode 17 and cause the laser to strike the sample plate 6. Ions produced from the sample plate surface by the MALDI process are accelerated by an electrical field between the sample plate 6 and the extraction electrode 17 supplied by the high-voltage pulse generator 9 to produce an ion beam 7B directed to the time-of-flight analyzer (not shown). The incident angle of the laser need not be limited to a small angle. The angle need only be such that will be aligned substantially along the perpendicular axis of the aperture and be aligned such that it will strike a spot on the sample plate.

Figure 4:
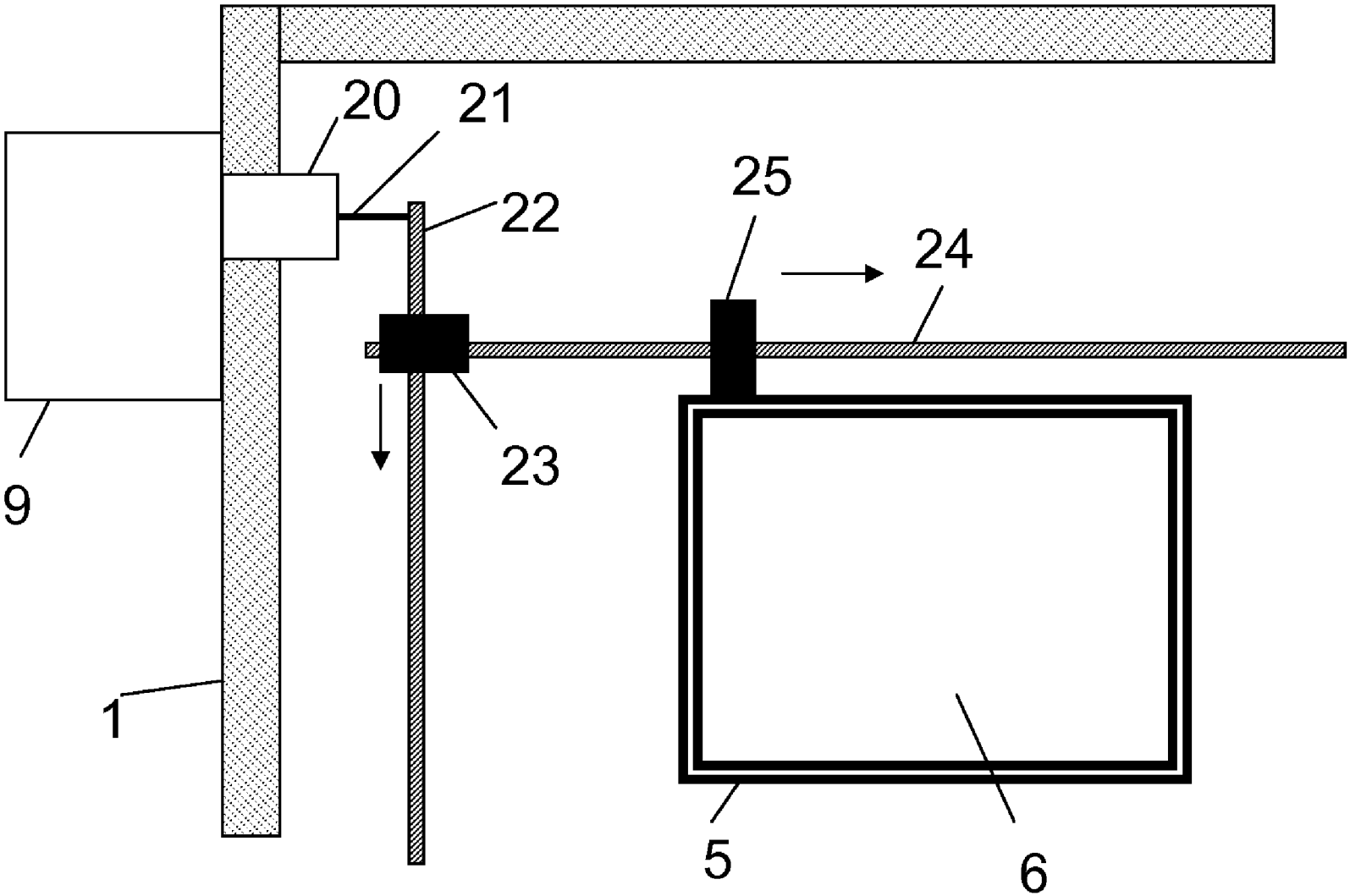
FIG. 4 is a depiction of a rigid connection between a high voltage pulse generator and a moveable sample plate in one embodiment.

FIG. 4 illustrates a rigid connection between the high voltage pulse generator 9 and the sample plate holder 5. The high voltage output of the high voltage pulse generator 9 enters the vacuum housing through high voltage vacuum feedthrough 20 and connects to a rigid rod 22 mounted rigidly to the vacuum housing 1 but is electrically insulated from the housing. The high voltage vacuum feedthrough 20 is connected to a first rigid rod 22 via a lead 21 which may be a wire or any flexible connecting apparatus. A second rigid rod 24 is electrically connected to the first rigid rod 22 through a first sliding connection device 23, and sample plate holder 5 is electrically connected to the second rigid rod 24 through a second sliding connection device 25.

In one embodiment the first and second rigid rods 22 and 24 are 3 mm diameter precision ground stainless steel shafts and the first and second sliding connection devices 23 and 25 are sintered bronze bushing impregnated with graphite. In the figure, the second rigid rod 24 is rigidly mounted to, but insulated from, the table providing motion of the sample plate holder 5 in the y direction. Motion of the sample plate holder 5 in the y-direction causes the first sliding connection device 23 to slide along the first rigid rod 22, and motion in the x-direction causes the second sliding connection device 25 to slide along the second rigid rod 24. Thus, as the plate is moved throughout the full range of motion required to obtain MALDI-TOF spectra from all samples on the sample plate, the electrical connection is maintained and the electrical capacitance to ground is independent of sample position since the position of the electrodes relative to the grounded ion source housing does not change.

Figure 5:
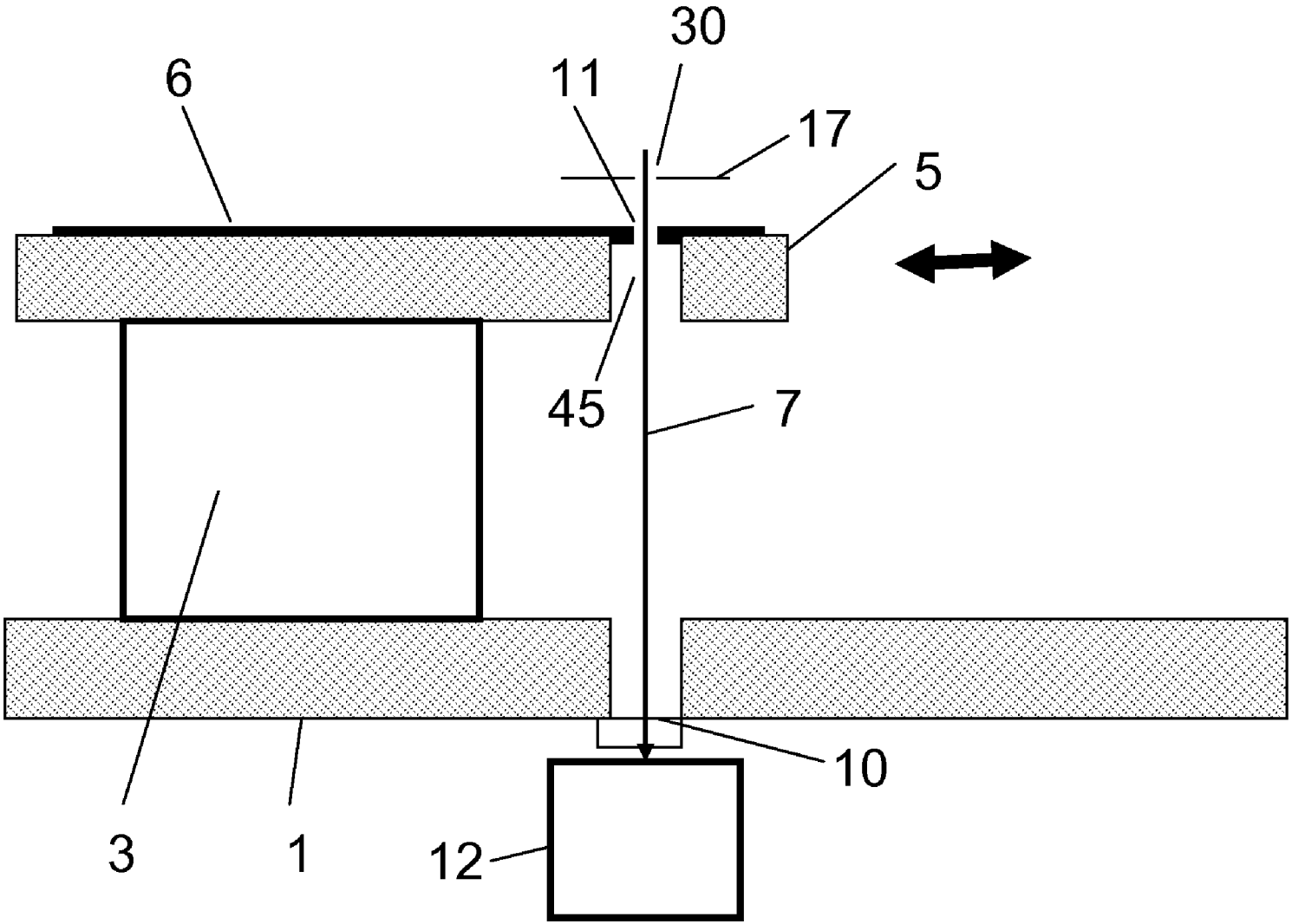
FIG. 5 is a cross-sectional view illustrating the method for plate alignment according to one embodiment.

FIG. 5 illustrates a method and apparatus for aligning predetermined positions on the sample plate 6 with the laser beam 7. The laser beam passes through the extraction electrode aperture 30 in the extraction electrode 17 and normally strikes a predetermined location on the sample plate to produce ions. However, when one of the holes 11 in the sample plate 6 is aligned with the laser beam, the beam passes through a sample plate holder aperture 45 in the sample plate holder 5 and through a bottom window 10 in the bottom of the ion source vacuum housing 1, and is detected by laser light detector 12. The laser beam 7 is accurately aligned with the center of the extraction electrode aperture 30 in the extraction electrode 17 so that in normal operation the laser beam strikes the surface of the sample plate at a position substantially on the axis of the extraction electrode aperture 30.

To determine the location of a hole in the sample plate relative to the laser beam the x-axis motion component 4 is activated to move the sample plate in the x-direction and the intensity detected by the laser light detector 12 is recorded as a function of the x coordinate as determined by the control system. The process is repeated by activating y-axis motion and recording the intensity detected by the laser light detector 12 as a function of the y-coordinate. The x and y coordinates corresponding to the maximum intensity and the points at which the intensity is reduced from the maximum by a predetermined amount, for example at one-half of the maximum intensity. The x and y coordinates corresponding to the laser beam at the center of the hole is then determined by analyzing the recorded intensities as a function of position. For example, the midpoint between the half-intensity points in both x and y provides a good measure of coordinates corresponding to the laser being centered in the hole. The use of multiple alignment holes provides redundancy and also allows any imperfections in the x-y table to be determined and corrected. If a similar plate alignment procedure is employed in devices used for loading samples on the sample plate, then this plate alignment procedure allows the laser to be precisely directed to any predetermined location on the sample plate containing samples of interest, independent of any imperfections in the x-y positioning systems.

Figure 6:
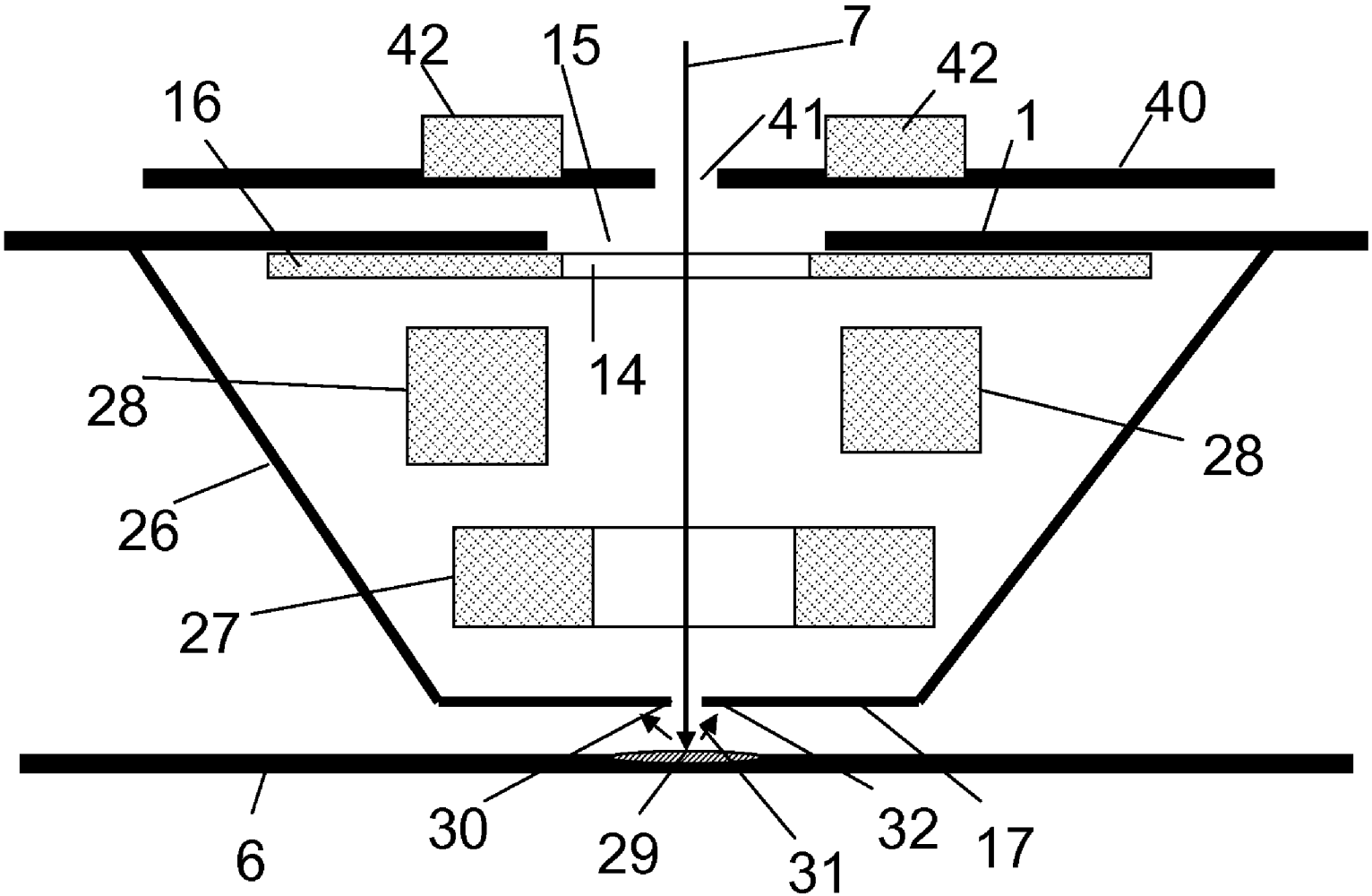
FIG. 6 is a cross-sectional schematic of an extraction electrode, gate valve, and ion optics.

Referring now to FIG. 6, a schematic expanded view of the extraction electrode, gate valve, and ion optical elements is represented. The laser beam 7 is directed through extraction electrode aperture 30 in extraction electrode 17 and strikes the sample plate 6 at a predetermined location or sample spot 29 on the sample plate containing samples of interest in matrix crystals.

In one embodiment the space between the extraction electrode 17 and the gate valve 16 is enclosed in a housing 26 so that the only significant gas conductance between the ion source vacuum housing 1 and the analyzer housing 13 is through extraction electrode aperture 30. Gate valve aperture 14 in gate valve 16 and aperture 15 in housing 1 are significantly larger in diameter than the aperture in extraction electrode 17.

In a preferred embodiment extraction electrode aperture 30 is 1 mm in diameter and the smaller of apertures 14 and 15 is more than 10 mm in diameter so that the conductance of apertures 14 and 15 is at least 100 times greater than the conductance of aperture 30. Thus, the pressure in the vicinity of the gate valve approaches the pressure in the analyzer housing 13 even though the pressure in the ion source housing chamber 1 may be two or three orders of magnitude higher.

In one example the pressure in the analyzer housing 13 is approximately $10^{-7}$ and the ion path length is 3000 mm. In one embodiment the distance between the sample plate 6 and the extraction electrode 17 is 3 mm. Thus, even though the pressure in the analyzer housing may be as much as 1000 times higher than the analyzer pressure in some examples, the probability of significant collisions between ions and neutral molecules is small.

Again referring to FIG. 6, the laser beam 7 impinges on the sample spot 29 containing samples of interest incorporated into matrix crystals. The laser vaporizes a portion of the sample and produces a plume 31 of vapor containing both neutral molecules and ions. The ions are accelerated by the electric field between the sample plate 6 and the extraction electrode 17, focused by an ion lens 27 and directed by deflectors 28 toward a time-of-flight analyzer (not shown). The neutral molecules and ions in the plume travel in straight lines in the vacuum and impinge on surfaces in their path such as the surface of the extraction electrode 17. Since the matrix molecules are nonvolatile at room temperature they tend to efficiently stick to the first surface they strike. Observations of the matrix deposits produced by MALDI indicate that concentration of molecules in the plume is relatively uniform within a plume 31 cone of about 45 degree half-angle about the axis of the laser, and the concentration fall off rapidly outside this cone. Thus, if the distance between the extraction electrode 17 and the sample plate 6 is 3 mm, then the desorbed matrix is deposited nearly uniformly over a circle 6 mm in diameter.

In one embodiment the extraction electrode aperture 30 in the extraction electrode 17 is 1 mm in diameter, thus about 3% of the desorbed matrix passes through the aperture and the remaining 97% is deposited on the extraction electrode surface 32 of the extraction electrode 17. The half-angle of the cone of matrix vapor passing through the extraction electrode aperture 30 is about 10 degrees, and these molecules continue in a straight line until they strike a surface. Thus if the apertures 14 and 15 are less than approximately 25 mm from the sample plate 6, then the diameter of the plume at that distance is less than 10 mm.

In one embodiment the diameters of apertures 14 and 15 and distances between deflectors 28 and the diameter of apertures in focusing elements, ion lenses 27 are chosen sufficiently large that they are not in the path of the plume that passes through the extraction electrode aperture 30 in the extraction electrode 17.

In one embodiment a baffle plate 40 is located in the analyzer housing 13 adjacent to the ion source housing 1. The baffle plate includes a baffle aperture 41 aligned with the laser beam that is sufficiently large in diameter to allow substantially all of the ions in the ion beam to pass, but intercept a large fraction of the plume of neutral molecules. The space between the baffle plate 40 and the housing 1 is chosen sufficiently large that the vacuum pumping speed is not inhibited.

In one embodiment the baffle aperture 41 is 2 mm in diameter and baffle plate 40 is located 30 mm from the sample plate 6. With this geometry the diameter of the matrix deposit on the baffle plate is approximately 10.6 mm, and the fraction of the 3% that passed through extraction electrode aperture 30 that also passes through baffle aperture 41 is approximately 4% with the remaining 96% deposited on the surface of baffle plate 40. Thus, only about 0.1% of the total amount of matrix desorbed passes through the baffle aperture 41 in the baffle plate 40 and enters the analyzer.

In one embodiment the baffle plate 40 is equipped with heaters 42 that can be energized to heat the plate 40 and vaporize any accumulated deposits. Since the rate of deposition on the surface of baffle plate 40 is much slower than the rate of deposition on the surface 32 of extraction electrode 17, it is not necessary to heat the baffle plate 40 continuously. Rather, it is desirable to heat the plate when the gate valve 16 is closed. This can be done when the gate valve is closed either to load a sample plate or to clean the extraction grid. Energizing the heaters 42 when the gate valve is closed causes any matrix deposits to be vaporized and re-deposited either on the surface of the analyzer housing 1, or on the back side of the gate valve slider. These are both locations that are hidden from the ion beam so that accumulation of matrix deposits in these regions cannot affect the performance of the instrument.

Figure 7:
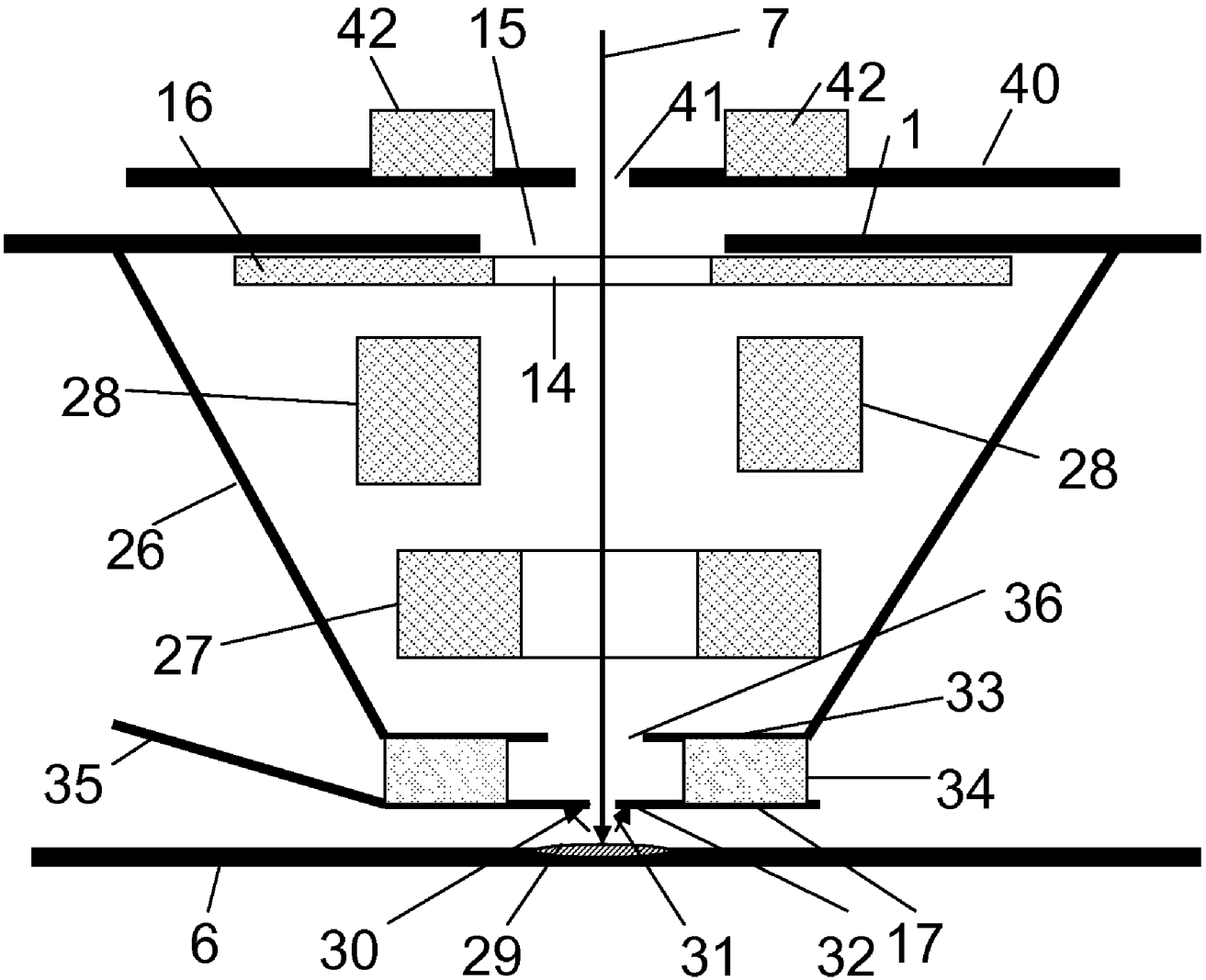
FIG. 7 is a cross-sectional schematic of an extraction electrode, gate valve, and ion optics in another embodiment with the extraction electrode isolated from ground potential.

Referring now to FIG. 7. In some embodiments the extraction electrode 17 is insulated from grounded housing 26 by insulator 34 that supports the extraction electrode 17 and seals the extraction electrode to the grounded housing so that essentially all gas flow from the source housing into the analyzer housing passes through aperture 30 in extraction electrode 17. Plate 33 forms a portion of housing 26 with an aperture 36 that is sufficiently larger than aperture 30 that essentially none of the vaporized matrix in plume 31 that passes through aperture 30 strikes plate 33. An external high voltage supply (not shown) set to provide a predetermined constant voltage is connected through connection mean 35 to extraction electrode 17. The same external high voltage supply is connected to the high voltage pulse generator 9 (shown in FIG. 4), and at a predetermined time following a laser pulse the high voltage pulse generator causes the voltage applied to sample plate 6 to switch from the predetermined voltage applied to the extraction grid to a second predetermined voltage causing ions produced by the laser pulse to be accelerated. This two-field ion source is preferred for applications requiring that ions be focused in time at a greater distance from the source than can readily be achieved using a single-field source as illustrated in FIG. 6.

Some analyzers may include critical ion optical components in the path of the neutral beam of matrix molecules transmitted through the baffle plate aperture 41 in the baffle plate 40. In those cases it may be necessary to heat the critical elements or take other measures to remove or prevent matrix deposition. The further removed these surfaces are from the sample plate 6, the lower the rate of deposition. Dealing with potential contamination of components in the analyzer is a matter for the design of the individual analyzer system and is beyond the scope of the present invention.

A major impediment to operating MALDI at high laser repetition rates is that the rate of deposition of nonvolatile matrix materials on critical surfaces if proportional to the laser rate. This is a particularly serious problem for the extraction electrode that is in close proximity to the sample plate and may intercept 95% or more of the desorbed matrix. Continuous operation of a MALDI system at a laser rate of 5 khz desorbs enough matrix in 24 hours to seriously damage the performance of an instrument by matrix deposition on the extraction electrode. Matrix deposition of surface at greater distance from the sample plate may be removed effectively, in some cases, by heating the surface in question. This does not appear to be a viable solution to the problem to deposition on the extraction electrode. The sample plate is located close to the extraction electrode. Thus it is difficult to heat the extraction electrode sufficiently to desorb deposited matrix without also heating the sample plate and vaporizing matrix from the sample. Also matrix and samples desorbed from the extraction electrode may be deposited back on the sample plate thus contaminating the samples on the plate.

Figure 8:
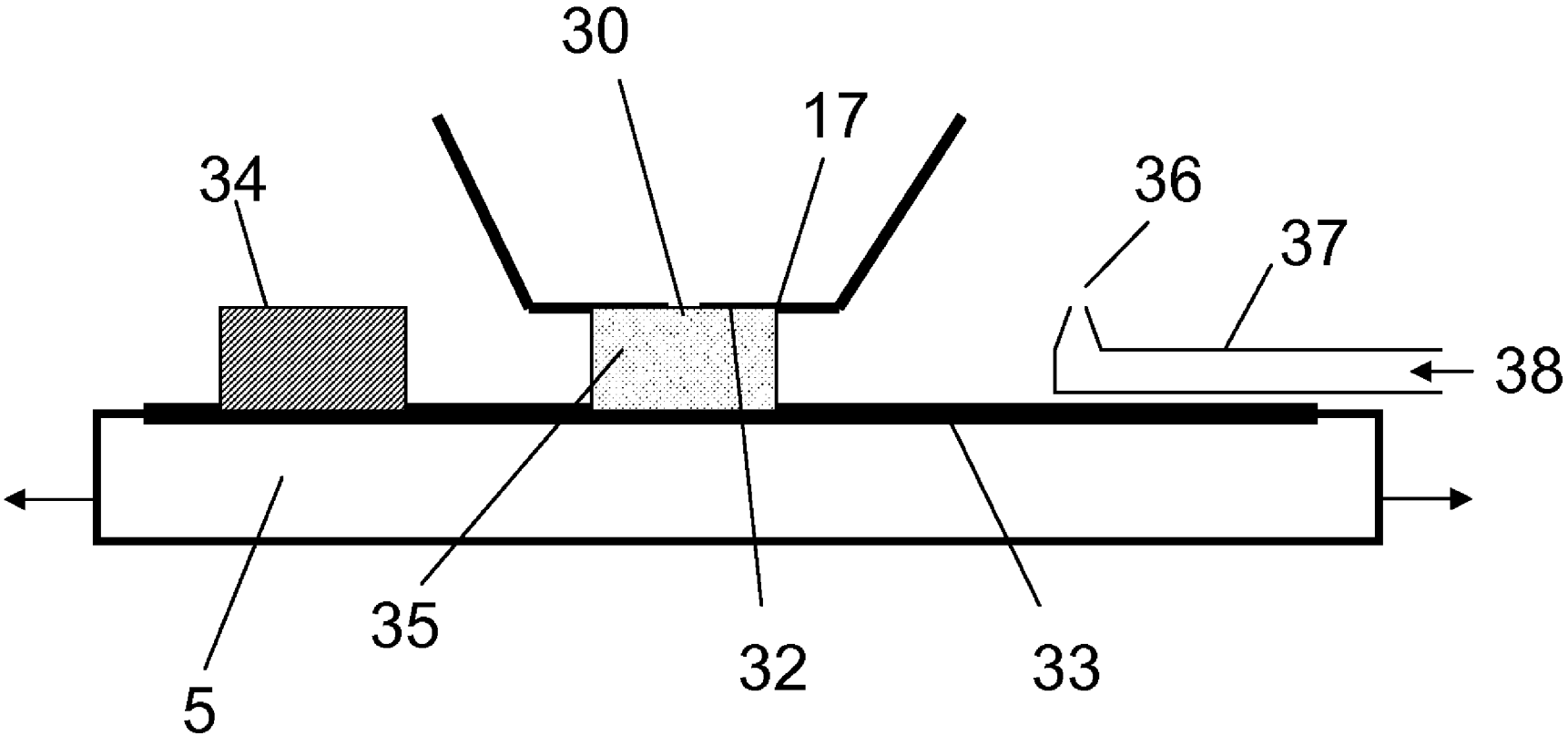
FIG. 8 is an illustration of the procedure for cleaning the extraction electrode.

FIG. 8 illustrates a method and apparatus for cleaning the extraction electrode. In this embodiment a surrogate sample plate 33 is loaded into sample plate holder 5 and transported into the vacuum housing 1 in the same manner as a normal sample plate 6. For cleaning the extraction electrode the vacuum generator 8 is not activated and the gate valve 16 remains closed so that the vacuum housing remains at atmospheric pressure. The high-voltage pulse generator 9 remains off.

The surrogate sample plate may comprise many cleaning means, each being used alone or in combination with other cleaning means. A few of these are depicted in FIG. 8 including an abrasive pad 34, a lint-free cloth pad 35, and a device for directing a liquid jet 36 at the surface 32 of the extraction electrode 17.

Since the ion source housing 1 is at atmospheric pressure during the cleaning procedure a flow of liquid 38 can be produced by an external pump and coupled through the open flap valve 2 via a conduit 37 to the liquid jet 36. A high pressure jet of air can also be introduced in a similar manner. To clean the surface 32 of the extraction electrode one of the cleaning means, for example 35, is brought into contact with the surface 32 around the aperture 30 in the extraction electrode 17, and the x-y table moved in a regular manner to remove deposited matrix form the surface. The surrogate plate 33 can be loaded manually at intervals as required for cleaning the extraction electrode, or if the system includes an automatic system for loading plates, a surrogate cleaning plate can be included periodically in the queue of sample plates and the procedure carried out automatically without operator intervention.

In one embodiment, a sample plate 6 may also contain a portion, grid or region dedicated to cleaning the electrode thereby serving as both a sample plate and a cleaning plate.

While this invention has been particularly shown and described with references to preferred embodiments thereof, it will be understood by those skilled in the art that various changes in form and details may be made therein without departing from the scope of the invention encompassed by the appended claims.

What is claimed is:

1. A system for use in MALDI-TOF mass spectrometry comprising:

(a) An ion source housing comprising:
  i) an x-y table for receiving and moving a sample plate in two dimensions transverse to the axis of a laser beam,
  ii) a sample plate holder for receiving said sample plate, and
  iii) a spring-loaded flap valve driven open by motion of the x-y;
(b) a TOF analyzer housing;
(c) a gate valve having a gate valve aperture located between the ion source housing and the TOF analyzer housing;
(d) a vacuum generator system operably connected to the ion source housing;
(e) an extraction electrode having an extraction electrode aperture; and
(f) a high-voltage pulse generator which can be operably connected to the sample plate.

2. The system of claim 1, wherein the portion of the x-y table for receiving a sample plate is electrically insulated from the ion source housing and is electrically connected to the ion source housing through a vacuum feed-through to an external high-voltage pulse generator.

3. The system of claim 2, wherein the electrical capacitance between the sample plate and the ion source housing is independent of the x-y position of the sample plate.

4. The system of claim 1, wherein the high-voltage pulse generator produces a pulse up to 10 kilovolts in amplitude at frequencies up to 5 kilohertz.

5. The system of claim 1, wherein the space between the extraction electrode and the gate valve is in vacuum communication with the ion source housing via the extraction electrode aperture and is in vacuum communication with the analyzer housing when the gate valve is open.

6. The system of claim 1, wherein the diameter of the aperture in the extraction electrode is less than the diameter of the aperture in the gate valve.

7. The system of claim 6 further comprising a baffle plate and a heater for heating said baffle plate.

8. The system of claim 1, wherein the x-y table has the capacity to receive sample plates up to 127×124×3 mm in dimension.

9. The system of claim 1 further comprising a laser detector, ion focusing lenses and deflection electrodes.

10. The system of claim 9, wherein the laser detector is located behind a window in the ion source housing opposite the extraction electrode aperture.

11. The system of claim 10, wherein the laser detector is further located behind one or more apertures of predetermined size and position in the sample plate and sample plate holder.

12. The system of claim 1 further comprising a surrogate sample plate compatible with the sample plate holder and which is used to clean matrix or other contaminants from the surface of the extraction electrode by programmed action of the x-y table.

13. The system of claim 12, wherein the surrogate plate also acts as a sample plate.

14. The system of claim 9, wherein said focusing lenses and deflection electrodes are located between the extraction electrode and the gate valve.

15. The system of claim 1, wherein the extraction electrode is at ground.

16. The system of claim 1, wherein a high voltage pulse is coupled to the sample plate having minimal capacitance to ground and substantially no variation of the capacitance relative to sample plate position.

17. A method for performing MALDI-TOF mass spectrometry with the system of claim 1 comprising the steps of:

(a) turning the high-voltage pulse and vacuum generators off and closing the gate valve;

(b) opening a vent valve in the ion source vacuum housing to bring the housing to atmospheric pressure;

(c) activating the x-y table to drive open the spring-loaded flap valve to expose the sample plate holder;

(d) inserting a sample plate containing samples into the sample plate holder;

(e) activating the x-y table to draw the sample plate holder into the ion source housing;

(f) evacuating the ion source housing to operating pressure by activating the vacuum generator;

(g) opening the gate valve and turning on the high-voltage pulse generator;

(h) positioning the sample plate to predetermined locations via movement of the x-y table; and (i) performing MALDI-MS at selected sample spots.

18. A method for cleaning the extraction electrode of the system of claim 1 comprising:

(a) turning the high-voltage pulse and vacuum generators off and closing the gate valve;

(b) opening a vent valve in the ion source vacuum housing to bring the housing to atmospheric pressure;

(c) activating the x-y table to drive open the spring-loaded flap valve to expose the sample plate holder;

(d) removing the sample plate if present in the holder and replacing it with a surrogate sample plate having a cleaning device for cleaning matrix deposits or other contaminants from the extraction electrode; and (e) activating the x-y table to move the surrogate sample plate in a predetermined pattern such that the cleaning device of the surrogate sample plate operates to remove matrix deposits or other contaminants from the surface of the extraction electrode.

19. The method of claim 18 further comprising returning the system to operational mode after cleaning comprising the steps of:

(a) Activating the x-y table is activated to drive open the spring-loaded flap valve exposing the sample plate holder containing the surrogate sample plate, followed by (b) Removing the surrogate sample plate in the holder and placing a sample plate in the sample plate holder.

20. The method of claim 18, wherein the cleaning device comprises an abrasive pad.

21. The method of claim 18, wherein the cleaning device comprises formation of a liquid jet or spray directed to the surface of the extraction electrode wherein the composition of the liquid is a solvent for the matrix compounds.

22. The method of claim 18, wherein the cleaning device comprises a lint-free cloth pad.

23. A method for cleaning a baffle plate of the system of claim 7 comprising:

(a) Closing the gate valve, (b) Activating a heater that heats said baffle plate for a predetermined time at a predetermined power input.

24. The method of claim 23 further comprising returning the system to operational mode after cleaning comprising opening the gate valve and turning off the heater.

25. The system of claim 1, wherein the gate valve aperture is substantially aligned with the extraction electrode aperture when the gate valve is open.

* * * * *